US005261587A

United States Patent [19]

Robinson

[11] Patent Number: 5,261,587

[45] Date of Patent: Nov. 16, 1993

[54] FASTENER-DRIVING TOOL WITH IMPROVED, ADJUSTABLE, TOOL-ACTUATING STRUCTURES

[75] Inventor: James W. Robinson, Mundelein, Ill.

[73] Assignee: Illinois Tool Works Inc., Glenview, Ill.

[21] Appl. No.: 417

[22] Filed: Jan. 4, 1993

[51] Int. Cl.[5] ..... B25C 1/08

[52] U.S. Cl. ..... 227/8; 227/142

[58] Field of Search ..... 227/8, 142

[56] References Cited

U.S. PATENT DOCUMENTS

| | | | |
|---|---|---|---|
| 4,767,043 | 8/1988 | Canlas, Jr. | 227/8 |
| 4,821,937 | 4/1989 | Rafferty | 227/8 |
| 4,903,880 | 2/1990 | Austin et al. | 227/8 |
| 5,054,678 | 10/1991 | Nasiatka | 227/8 |
| 5,069,379 | 12/1991 | Kerrigan | 227/8 |
| 5,197,646 | 3/1993 | Nikolich | 227/8 |

*Primary Examiner*—Scott A. Smith
*Attorney, Agent, or Firm*—Schwartz & Weinrieb

[57] ABSTRACT

In a fastener-driving tool, a primary structure, an intermediate structure, and a secondary structure are separately movable along a tool axis. The primary structure is biased to a tool-disabling position, is movable along the tool axis to a tool-enabling position, and is engaged by an upper end of the intermediate structure. The secondary structure has a lower end to be firmly pressed against a workpiece. A bolt is threadedly adjustable within an axial socket of the intermediate structure. A spring disposed around the bolt shank, between the bolt head and a flange on the secondary structure, biases the intermediate structure in one direction. The bolt head has flat surfaces, one of which is engaged by a tab on another flange of the secondary structure so as to prevent bolt rotation unless the secondary structure is moved against the spring bias, whereupon the bolt can then be rotated.

9 Claims, 4 Drawing Sheets

FASTENER-DRIVING TOOL WITH IMPROVED, ADJUSTABLE, TOOL-ACTUATING STRUCTURES

TECHNICAL FIELD OF THE INVENTION

This invention pertains to a fastener-driving tool, which may be pneumatically powered or combustion-powered, and which has improvements enabling the tool to be readily adjusted to adjust the depth of penetration of fasteners driven by the tool. The fasteners may be nails or staples.

BACKGROUND OF THE INVENTION

Fastener-driving tools, which may be pneumatically powered or combustion-powered, are used widely in building construction. Such pneumatically powered tools are exemplified in Golsch U.S. Pat. No. 4,932,480. Such combustion-powered tools are exemplified in Nikolich U.S. Pat. Re. 32,452 and in Nikolich U.S. patent application Ser. No. 07/848,277 filed Mar. 9, 1992.

Typically, such a pneumatically powered or combustion-powered tool includes a housing structure, a nosepiece extending from the housing structure, a primary actuating structure, and a secondary actuating structure. Both of these actuating structures are movably mounted upon the nosepiece. The primary actuating structure is movable between a tool-disabling position relative to the housing structure and a tool-enabling position relative thereto and is biased to the tool-disabling position. Typically, the fastener-driving tool also includes a trigger, which must be manually actuated to operate the tool once the tool has been enabled.

The primary actuating structure is arranged to enable the tool when such structure is moved to the tool-enabling position and to disable the tool when such structure is moved from the tool-enabling position. The secondary actuating structure is arranged to move the primary actuating structure to the tool-enabling position when the secondary actuating structure is pressed firmly against a workpiece.

For various applications, it is known to drive the fasteners to different depths of penetration so that their heads are flush with a workpiece, so that their heads remain disposed above the workpiece, or so that their heads are countersunk into the workpiece. Means known heretofore for adjusting the secondary actuating structure of such a tool so as to adjust the depths of penetration of fasteners driven by the tool into a workpiece have not been entirely satisfactory.

SUMMARY OF THE INVENTION

This invention provides improvements in a fastener-driving tool comprising a housing structure, which defines an axis, and a nosepiece extending axially from the housing structure, along with a primary actuating structure and a secondary actuating structure. The primary actuating structure is movable between a tool-enabling position relative to the housing structure and a tool-disabling position relative thereto and is biased to the tool-disabling position. The primary actuating structure enables the tool when the primary actuating structure is moved to the tool-enabling position and disables the tool when the primary actuating structure is moved away from the tool-enabling position. The secondary actuating structure is movably mounted upon the nosepiece and is adapted to be firmly pressed against a workpiece.

An intermediate structure is also movably mounted upon the nosepiece. The intermediate structure is engaged with the primary actuating structure. A bolt has a head and a shank with a portion, which is threaded adjustably threaded into an axial socket in one of the intermediate and secondary actuating structures. The intermediate and secondary actuating structures are mounted so as to be relatively movable over a limited range of relative movement and are biased so as to hold the bolt head against a flange extending from the other one of the intermediate and secondary actuating structures.

Preferably, the bolt head has flat surfaces parallel to the axis and the flange has an axially extending tab, which is disposed to engage a selected one of the flat surfaces to prevent bolt rotation when the bolt head is held by the flange with the selected surface facing the tab. The flange and the bolt head are separable by relative movement of the intermediate and secondary actuating structures so as to permit the bolt head to clear the tab and the bolt to then be rotated. The secondary actuating structure may also have a raised formation disposed to engage another one of the flat surfaces when the bolt head is held by the flange with the selected surface facing the tab.

If the flats define a regular polygon, such as a regular hexagon, the bolt may be a conventional bolt having a polygonal head. If such a bolt is used, the bolt may be adjusted by regular, angular intervals (such as, for example, 60° intervals if such flats define a regular hexagon) so as to enable the depths of penetration of fasteners driven by the tool to be adjusted by regular, precise intervals.

Preferably, the intermediate and secondary actuating structures are biased by a coiled spring disposed around the bolt shank. Preferably, moreover, the intermediate element has the axial socket and the secondary actuating element has the flange with the axially extending tab. In a preferred embodiment, in which the flange therewith is a lower flange, the secondary actuating element also has an upper flange spaced axially from the flange with such tab, and the coiled spring is disposed between the bolt head and the upper flange.

BRIEF DESCRIPTION OF THE DRAWINGS

These and other objects, features, and advantages of this invention will become evident from the following description of a preferred embodiment of this invention with reference to the accompanying drawings, in which like reference characters designate like or corresponding parts throughout the several views, and wherein.

DETAILED DESCRIPTION OF PREFERRED EMBODIMENT

Figure 1:
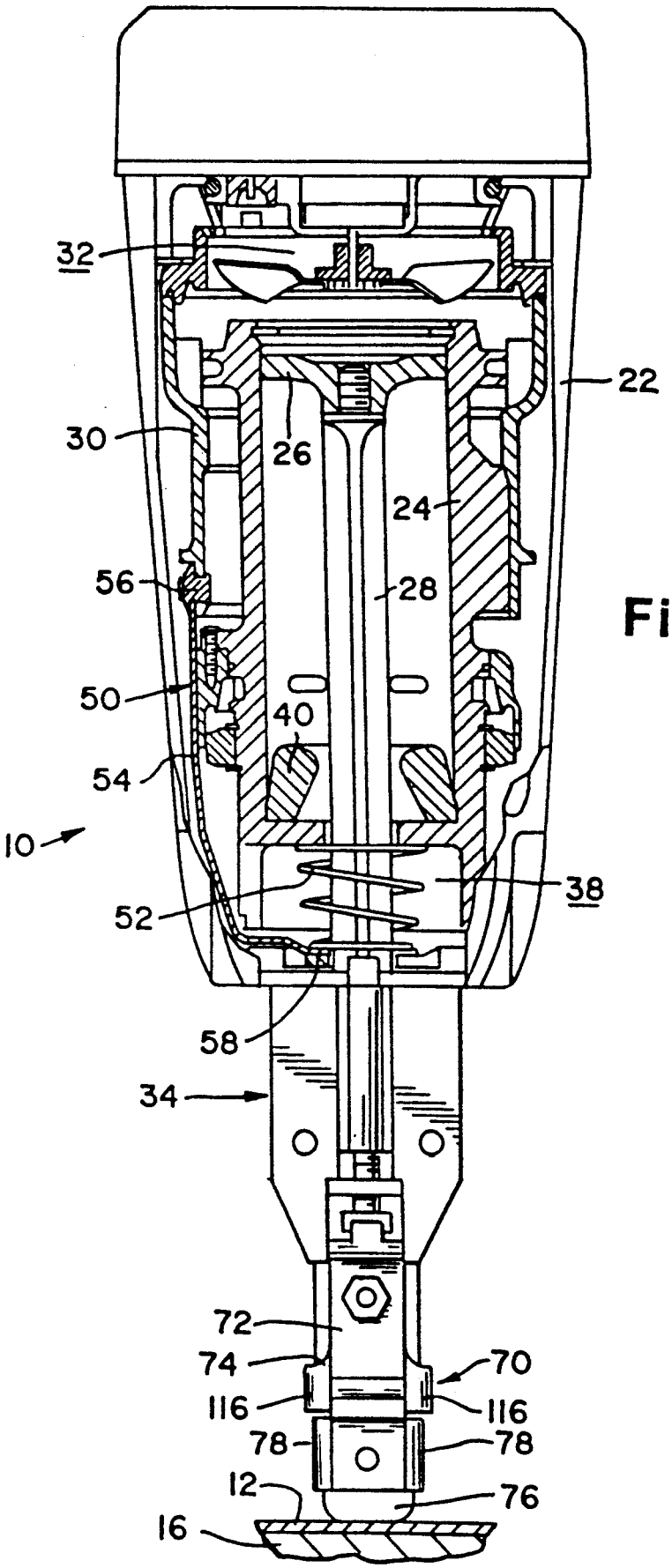
FIG. 1 is an elevational view taken partly in cross-section and showing a combustion-powered, fastener-driving tool embodying this invention. A workpiece and a substrate are shown fragmentarily.

As shown in FIG. 1, this invention may be embodied in a combustion-powered, fastener-driving tool 10, which is shown being used to drive fasteners (not shown) through a workpiece 12 into an underlying substrate 16. Although it is convenient to illustrate the tool 10 in a vertical orientation, as in FIG. 1, the tool 10 may be also used if rotated from the vertical orientation. Herein, "upper", "lower", "inner", "outer", and other directional terms refer to the tool 10 in the vertical orientation and are not intended to limit this invention to any particular orientation.

The tool 10 comprises a housing structure 22, within which a cylinder body 24 is fixedly mounted. The cylinder body 24 defines a tool axis. A piston 26 is operatively mounted in the cylinder body 24. The piston 26 is arranged to drive a driving blade 28 extending axially from the cylinder body 24. A valve sleeve 30 is mounted in axially movable relation to the cylinder body 24. The cylinder body 24 and the valve sleeve 30 define a combustion chamber 32. The valve sleeve 30 is axially movable, along the cylinder body 24, so as to open and close the combustion chamber 32. A nosepiece 34 is mounted to the housing structure 22, in axially spaced relation to the cylinder body 24. A lower chamber 38 is defined between the cylinder body 24 and the nosepiece 34. A resilient bumper 40 is disposed within the cylinder body 24 for arresting the piston 26.

A primary actuating structure 50 is provided for closing the combustion chamber 32 when a secondary actuating structure to be later described is pressed firmly against the workpiece 12. The structure 50 includes plural (such as, for example, four) arms 54 (one shown) connected to the valve sleeve 30 by fasteners 56 (one shown) so as to be conjointly movable with the valve sleeve 30. The structure arms 54 are connected to each other and to the secondary actuating structure by an annular member 58 disposed within the lower chamber 38 and across the tool axis. The structure arms 54 are shaped so as to extend outwardly from the lower chamber 38 and upwardly along the cylinder body 24.

A coiled spring 52, which is disposed within the lower chamber 38, is compressible between the cylinder body 24 and the annular member 58 of the primary actuating structure 50, so as to bias the valve sleeve 30, by means of the structure 50, to a tool-disabling position, in which the combustion chamber 32 is opened. The lower chamber 38 provides axial clearance, such as, for example, about one inch of axial clearance, to permit a limited range of axial movement of the structure arms 54 and the annular member 58 relative to the cylinder body 24, the nosepiece 34, and the housing structure 22 between the tool-disabling position and a tool-enabling position, in which the combustion chamber 32 is closed. The tool 10 is disabled when the combustion chamber 32 is not closed. The tool 10 comprises a manually actuatable trigger (not shown) which must also be actuated, after the combustion chamber 32 has been closed to enable the tool 10, so as to operate the tool 10 for driving a fastener, such as a nail or a staple.

As described in the preceding three paragraphs, except for the manner in which the structure 50 is moved to the tool-enabling position, the tool 10 is similar to combustion-powered, staple-driving tools available commercially from ITW Paslode, supra, under its IMPULSE trademark. Thus, except as illustrated and described herein, other structural and functional details of the tool 10 can be readily supplied by persons having ordinary skill in the art and are outside the scope of this invention.

Figure 2:
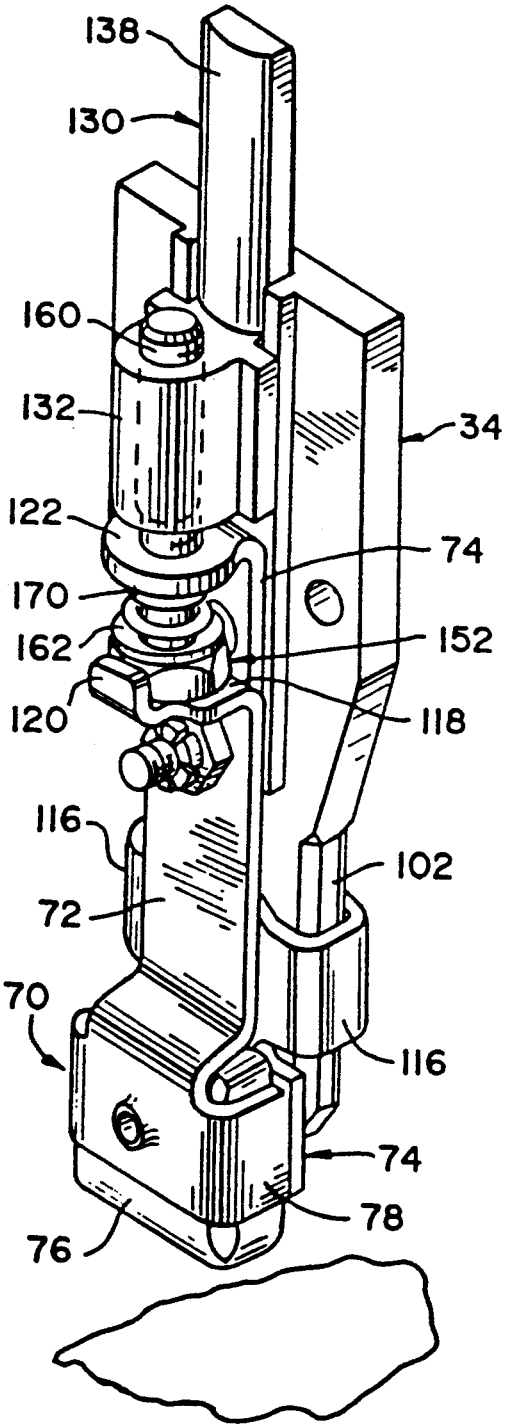
FIGS. 2 and 3 are enlarged, perspective views of certain actuating and related structures apart from other structures of the tool shown in FIG. 1, respectively in positions for tool operation and in positions for tool adjustment.
Figure 3:
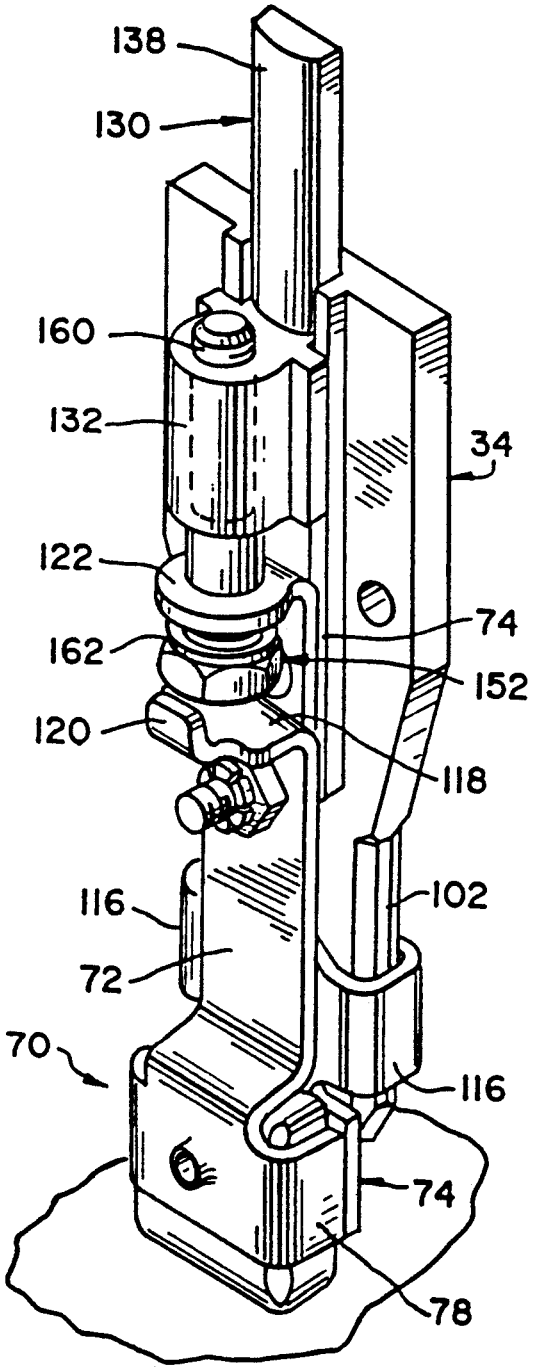
Figure 4:
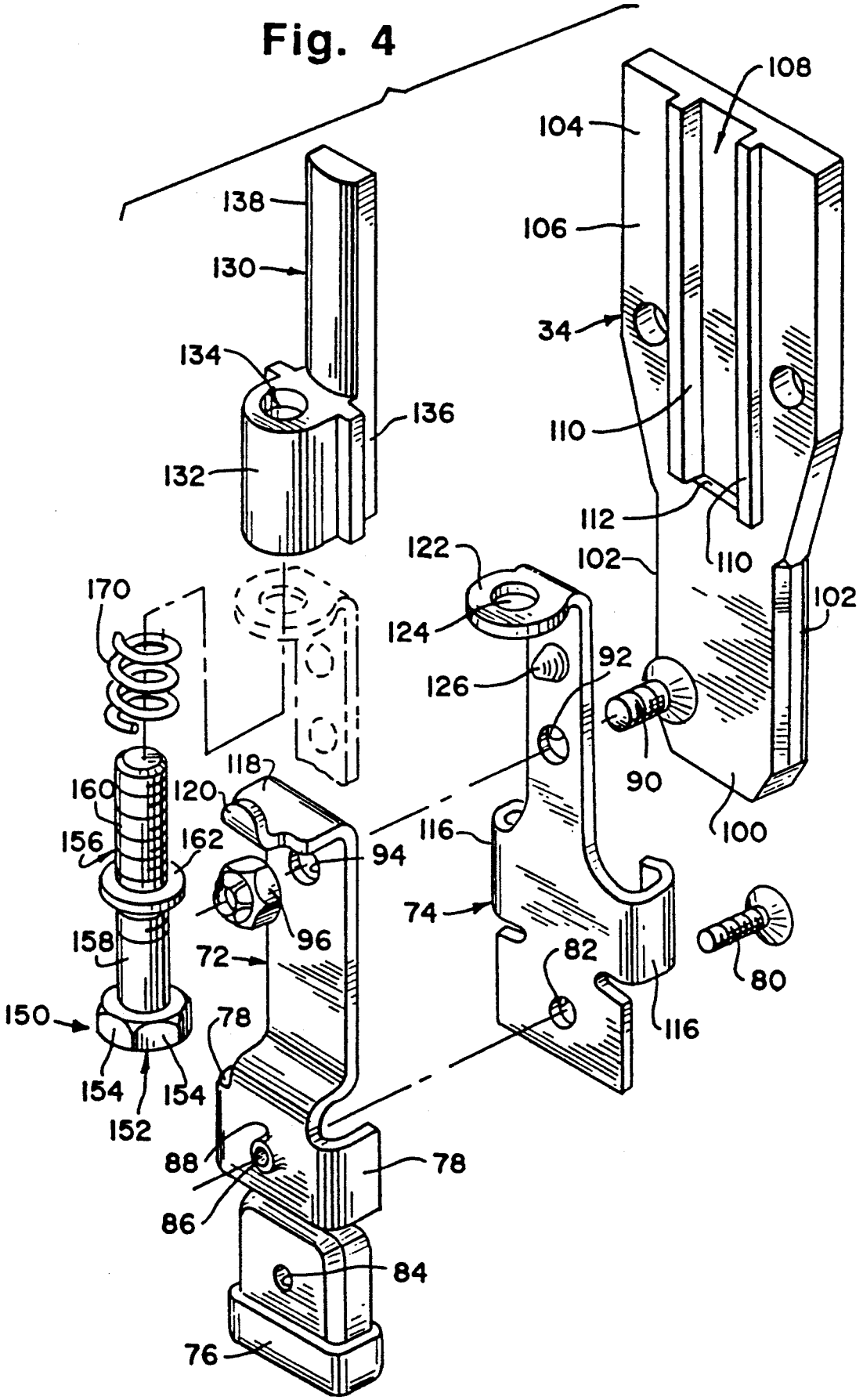
FIG. 4 is an exploded, perspective view of certain actuating and related structures shown in FIGS. 2 and 3, apart from other structures of the tool.

As shown in FIGS. 2, 3, and 4, the tool 10 further comprises a secondary actuating structure 70 including a front bracket 72, a back bracket 74, and a resilient tip 76. The front bracket 72 is shaped so as to define two lateral arms 78, between which the resilient tip 76 is confined. A machine screw 80 extending through a chamfered hole 82 in the back bracket 74, through an aligned bore 84 in the resilient tip 76, and into an aligned, threaded aperture 86 in a raised portion 88 of the front bracket 72, mounts the brackets 72, 74, to each other and mounts the resilient tip 76 to the brackets 72, 74 as best seen in FIG. 4. A machine screw 90 extending through a chamfered hole 92 in the back bracket 74, and through an aligned hole 94 in the front bracket 72, and receiving a hex nut 96 also mounts the brackets 72, 74, to each other. The resilient tip 76 is made from a suitable, resilient material, such as synthetic rubber, and extends beyond the brackets 72, 74. The resilient tip 76 is used to minimize risks of marring the workpiece 12. A different tip (not shown) of a similar or different type may be readily interchanged with the resilient tip 76.

As shown in FIG. 4 and other views, the nosepiece 34 has a lower portion 100 with two axial edges 102 and an upper portion 104, which is attached to the housing structure 22 in a suitable manner. Upon the front face 106, the upper portion 104 has an axial groove 108, which is bounded laterally by two parallel ribs 110 extending from the front face 106. At an upper end, the axial groove 108 is open. At a lower end, the axial groove defines a ledge 112.

The back bracket 74 has two lateral arms 116, which extend around the axial edges 102 of the lower portion 100 of the nosepiece 34, so as to permit the back bracket 74 to move axially along such portion 100. The back bracket 74 is retained on the nosepiece 34 in a manner to be later described.

At an upper end, the front bracket 72 has a flange 118 with a tab 120 extending axially toward the housing structure 22. At an upper end, the back bracket 74 has a flange 122 spaced axially toward the housing structure 22 from the flange 118. The flange 122 has a hole 124 for a purpose to be later described. Moreover, the back bracket 74 has a raised formation 126, which is opposite to the tab 120. The flange 118, the tab 120, and the formation 126 define a pocket for a purpose to be later described. Referring to the secondary actuating structure 70, as assembled, it is convenient to refer to the flange 118 as a lower flange and to refer to the flange 122 as an upper flange.

The tool 10 further includes an intermediate structure 130, which has a socket portion 132 defining an axial, threaded socket 134 therethrough and a slide portion 136 shaped to slidably fit within the axial groove 108 of the nosepiece 34, between the parallel ribs 110. The ledge 112 limits the downward movement of the slide portion 136 relative to the nosepiece 34. The slide portion 136 extends axially toward the housing structure 22 to define a probe 138, which engages the annular member 58 of the primary actuating structure 50 so that the primary actuating structure 50 is moved to the tool-enabling position, against the spring bias of the coiled spring 52, when the intermediate structure 130 is moved axially along the nosepiece 34, toward the housing structure 22. However, for a reason to be later described, the probe 138 is not attached to the annular member 58.

The tool 10 further includes a conventional bolt 150, which has a head 152 with six flats 154 defining a regular hexagon and a shank 156 with an unthreaded portion 158 near the head 152 and a threaded portion 160, an annular washer 162, and a coiled spring 170. The head 152 is disposed in the pocket formed by the flange 118, the tab 120, and the formation 126 with a selected flat 154 facing the tab 120 and with the opposite flat 154 facing the formation 126. The shank 156 extends axially through the annular washer 162, through the coiled spring 170, and through the hole 124 in the flange 122, with the threaded portion 160 threaded into the threaded socket 134.

After the shank 156 of the bolt 150 has been extended through the annular washer 162, the coiled spring 170, and the hole 124 in the flange 122, and after the resilient tip 76 has been attached to the back bracket 74 by means of the screw 80, the back bracket 74 may then be attached to the front bracket 72 by means of the screw 90 and the nut 96. Thus, the coiled spring 170 is initially compressed between the washer 162 and the flange 122 so that the washer 162 bears against the bolt head 152, and so that the bolt head 152 bears against the flange 118. The lateral arms 116 of the back bracket 74 may then be movably positioned on the lower portion 100 of the nosepiece 24, and the intermediate structure 130 may then be positioned with the slide portion 136 fitting slidably within the nosepiece groove 108 and with the probe 138 extending toward the annular member 58 of the primary actuating structure 50. The threaded portion 160 of the bolt shank 156 may then be threaded into the threaded socket 134.

When it is desired to adjust the axial distance between the upper end of the probe 138 and the lower end of the resilient tip 76, so as to thereby adjust the depth of the penetration of the fasteners driven by the tool 10, the secondary actuating structure 70 is pulled downwardly along the nosepiece 34, away from the housing structure 22, so as to compress the coiled spring 170 sufficiently for the bolt head 152 to clear the tab 120 and the formation 126. As a result, the tool 10 is disabled. The bolt 150 can then be rotated by means of an operator's fingertips in accordance with a more preferred mode of tool adjustment, or by means of a wrench (not shown) in accordance with a less preferred mode of tool adjustment, so as to adjust the axial distance between the bolt head 152 and the socket portion 132 of the intermediate structure 130.

Precise adjustments of the depth of the penetration of the fasteners driven by the tool 10 can thus be made. As an example, if the threaded portion 160 of the bolt shank 156 and the threaded socket 134 have 20 threads per inch, one complete rotation of the bolt 150 advances or retracts the bolt 150 axially by 0.050 inch. Since the flat surfaces 154 define a regular hexagon, the bolt 150 can be rotatably adjusted by regular, angular increments of 60° each.

Figure 5:
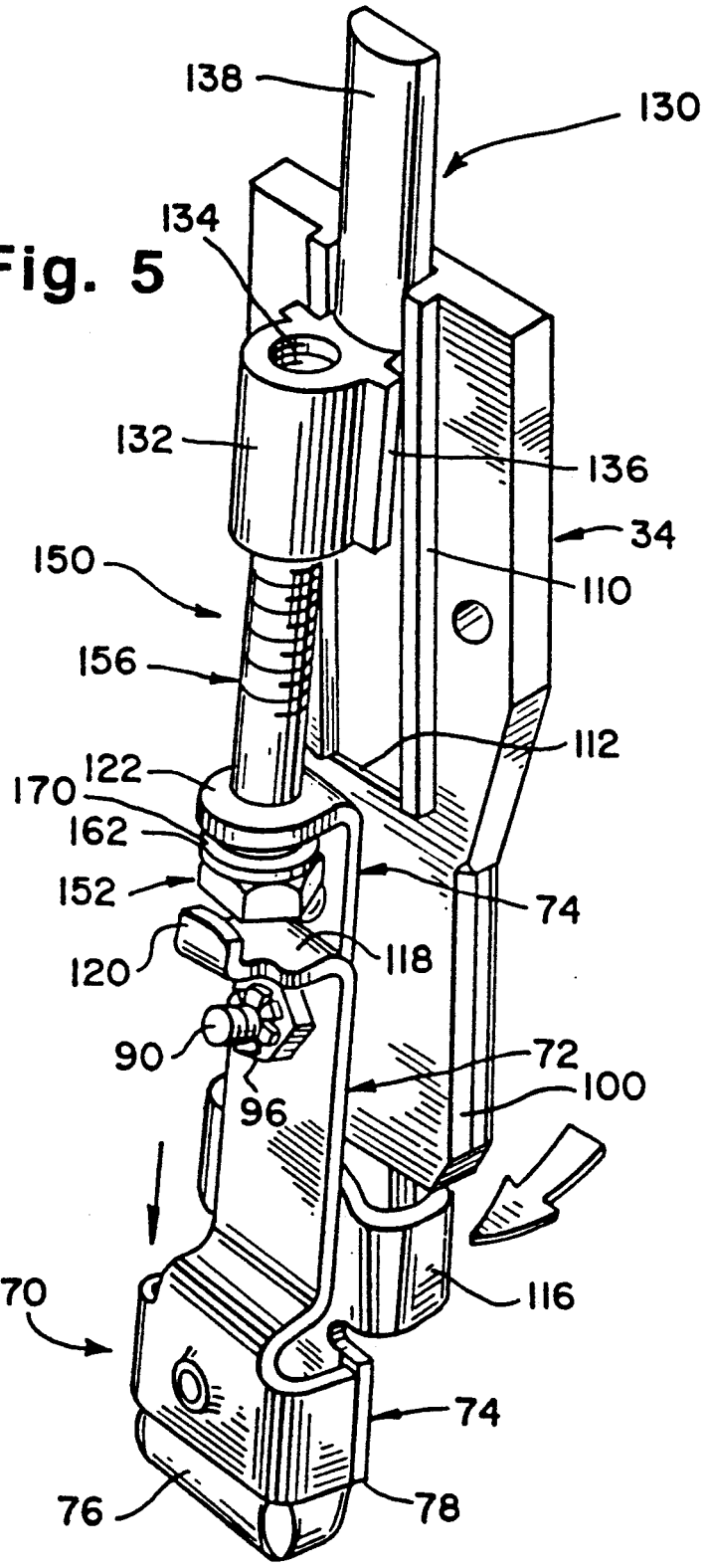
FIG. 5 is a view similar to FIGS. 2 and 3 but taken to show one mode of disassembly of certain actuating structures from another structure of the tool.

As shown in FIG. 5, the secondary actuating structure 70 and the intermediate structure 130, along with the bolt 150, the washer 162, and the spring 170, as assembled by means of the machine screws 80, 90, can be readily removed from the nosepiece 34, as for repair or for substitution of a different tip (not shown) for the resilient tip 76, without disassembly. FIG. 5 shows one possible way to remove the assembled structures 70, 130, from the nosepiece 34. First, the bolt 150 is adjusted so as to extend from the threaded socket 134 sufficiently for the lateral arms 116 of the back bracket 74 to clear the lower portion 100 of the nosepiece 34 when the secondary actuating structure 70 is pulled downwardly along the nosepiece 34. Next, the secondary actuating structure 70 is pulled downwardly along the nosepiece 34, whereupon the assembled structures 70, 130, are pivoted so that the slide portion 136 of the intermediate structure 130 clears the ledge 112 so that the assembled structures 70, 130, can then be removed. Because the probe 138 is not connected to the annular member 58 of the primary actuating structure, the assembled structures 70, 130, can be pivoted as shown.

The assembled structures 70, 130, may also be removed from the nosepiece 34 in another way if the lateral arms 78 of the front bracket 72 loosely embrace the lower portion 100 of the nosepiece 34 so as to allow some pivotal movement of the front bracket 72 relative to the nosepiece portion 100, and if there is sufficient clearance between the bolt shank 156 and the flange 122 so as to permit some pivotal movement of the bolt 150 relative to the flange 122. Thus, when the secondary actuating structure 70 is pulled downwardly for a sufficient distance so as to enable the bolt head 152 to clear the tab 120, the slide portion 136 of the intermediate actuating structure 130 can clear the ledge 112 of the nosepiece 34 if the assembled structures 70, 130, are pulled away from the nosepiece 34 at the flange 122 or at the bolt head 152.

Various modifications may be made in the preferred embodiment described above without departing from the scope and spirit of this invention. It is therefore to be understood that within the scope of the appended claims, the present invention may be practiced otherwise than as specifically described herein.

I claim:

1. A fastener-driving tool, comprising:

a housing structure which defines an axis;

a nosepiece extending axially from said housing structure;

a primary actuating structure movable between a tool-enabling position relative to said housing structure and a tool-disabling position relative to said housing structure, and biased toward said tool-disabling position, for enabling said tool when said primary actuating structure is moved to said tool-enabling position and for disabling said tool when said primary actuating structure is moved away from said tool-enabling position;

a secondary actuating structure movably mounted upon said nosepiece and adapted to be firmly pressed against a workpiece;

an intermediate structure movably mounted upon said nosepiece, engaged with said primary actuating structure, and interposed between said secondary actuating structure and said primary actuating structure for transmitting movement of said secondary actuating structure, when said secondary actuating structure is pressed against said workpiece, to said primary actuating structure so as to move said primary actuating structure from said tool-disabling position to said tool-enabling position; and means defined between said secondary actuating structure and said intermediate structure for adjustably mounting said secondary actuating structure with respect to said intermediate structure, and said nosepiece such that said secondary actuating structure is relatively adjustable over a limited range of relative positions with respect to said nosepiece such that the relative position of said secondary actuating structure with respect to said workpiece is accordingly adjusted whereby the depth of penetration of fasteners driven by said tool and into said workpiece may be adjusted.

2. The fastener-driving tool as set forth in claim 1, wherein said means for adjustably mounting said secondary actuating structure with respect to said intermediate structure comprises:

a threaded socket portion defined upon said intermediate structure;

a bolt having a head portion, and a threaded shank portion for adjustably threadedly engaging said threaded socket portion of said intermediate structure;

a pair of axially spaced flanges defined upon said secondary actuating structure; and a coiled spring interposed between said head of said bolt and one of said pair of flanges of said secondary actuating structure for biasing a second one of said pair of flanges of said secondary actuating structure into engagement with said head of said bolt for determining an adjustable position of said secondary actuating structure with respect to said nosepiece and workpiece.

3. The fastener-driving tool of claim 2, wherein:

said bolt head has flat surfaces disposed parallel to said axis;

said second one of said flange has an axially extending tab disposed thereon for engaging a selected on of said flat surfaces of said bolt head so as to prevent rotation of said bolt when said bolt head is engaged by said second one of said flanges and said selected one of said flat surfaces is engaged by said tab of said second one of said flanges; and said second one of said flanges and said bolt head are axially separable by relative movement of said intermediate and secondary actuating structures against the biasing force of said coiled spring so as to permit said bolt head to clear said tab of said second one of said flanges and thereby be disengaged with respect to said tab of said second one of said flanges so as to permit rotational adjustment of said bolt within said threaded socket portion of said intermediate structure.

4. The fastener-driving tool of claim 3 wherein the flat surfaces define a regular polygon.

5. The fastener-driving tool of claim 4 wherein the flat surfaces define a regular hexagon.

6. The fastener-driving tool of claim 4 wherein the intermediate and secondary actuating structures are biased by said coiled spring which is disposed around the bolt shank.

7. The fastener-driving tool of claim 5 wherein the flange with the axially extending tab is a lower flange, said one flange comprises an upper flange spaced axially from the lower flange, the coiled spring being disposed between the bolt head and the upper flange.

8. The fastener-driving tool of claim 7 wherein the secondary actuating structure also has a raised formation disposed to engage another one of the flat surfaces to prevent bolt rotation when the bolt head is held by the lower flange with the selected surface facing the tab.

9. The fastener-driving tool as set forth in claim 1, wherein:

said intermediate and secondary actuating structures are slidably mounted upon said nosepiece.

* * * * *